US012397208B2

(12) United States Patent
Kirtley et al.

(10) Patent No.: US 12,397,208 B2
(45) **Date of Patent: *Aug. 26, 2025**

(54) GOLF BAGS, GOLF BAG TOPS AND METHODS TO MANUFACTURE GOLF BAGS AND GOLF BAG TOPS

(71) Applicant: PARSONS XTREME GOLF, LLC, Scottsdale, AZ (US)

(72) Inventors: Daniel C. Kirtley, Tempe, AZ (US); Duane E. Pacha, Chandler, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 788 days.

This patent is subject to a terminal disclaimer.

(21) Appl. No.: 17/668,533

(22) Filed: Feb. 10, 2022

(65) Prior Publication Data

US 2022/0266104 A1 Aug. 25, 2022

Related U.S. Application Data

(63) Continuation-in-part of application No. 17/348,991, filed on Jun. 16, 2021, now Pat. No. 11,806,593, which is a continuation of application No. 16/216,736, filed on Dec. 11, 2018, now Pat. No. 11,065,516.

(60) Provisional application No. 63/151,154, filed on Feb. 19, 2021, provisional application No. 62/607,387, filed on Dec. 19, 2017.

(51) Int. Cl.
*A63B 55/40* (2015.01)

(52) U.S. Cl.
CPC ..... *A63B 55/40* (2015.10); *A63B 2209/08* (2013.01)

(58) Field of Classification Search
CPC ..... A63B 55/40; A63B 2209/08
USPC ..... 206/315.6
See application file for complete search history.

(56) References Cited

U.S. PATENT DOCUMENTS

| | | | | |
|---|---|---|---|---|
| 4,881,638 | A | 11/1989 | Cho | |
| 4,932,523 | A * | 6/1990 | Yamazoe | A63B 60/64 206/315.6 |
| 5,176,253 | A | 1/1993 | Perrin et al. | |
| 5,860,520 | A | 1/1999 | Tang | |
| 6,145,660 | A * | 11/2000 | Chou | A63B 55/40 206/315.6 |
| 6,375,004 | B1 | 4/2002 | Tuerschmann et al. | |
| 6,877,604 | B2 | 4/2005 | Pratt et al. | |
| D513,876 | S | 1/2006 | Solheim et al. | |
| D513,877 | S | 1/2006 | Solheim et al. | |
| D513,878 | S | 1/2006 | Anderson et al. | |
| D520,752 | S | 5/2006 | Solheim et al. | |

(Continued)

*Primary Examiner* — Sue A Weaver

(57) ABSTRACT

Exemplary embodiments of golf bags, golf bag tops, and methods to manufacture golf bags and golf bag tops are generally described herein. In one example, a golf bag top may include a club divider portion and a handle portion. A club fastener portion may extend from the handle portion and may receive a golf club shaft. A magnetic portion in the club fastener portion may magnetically attract the shaft. A magnet cover portion may be coupled to the club fastener portion and may include a flap portion entirely or partially covering the magnetic portion that would otherwise directly contact the shaft. The flap portion may provide physical separation between the magnetic portion and the shaft without prohibiting magnetic attraction therebetween. Other embodiments may be described and claimed.

20 Claims, 12 Drawing Sheets

(56) References Cited

U.S. PATENT DOCUMENTS

| | | | | |
|---|---|---|---|---|
| D522,754 | S | 6/2006 | Anderson | |
| D530,922 | S | 10/2006 | Anderson | |
| 7,124,886 | B2 | 10/2006 | Heidenreich | |
| D538,042 | S | 3/2007 | Suggs | |
| D544,210 | S | 6/2007 | McGuire et al. | |
| D557,501 | S | 12/2007 | Suggs et al. | |
| D557,502 | S | 12/2007 | Quartarone et al. | |
| D577,916 | S | 10/2008 | Quartarone et al. | |
| D580,656 | S | 11/2008 | Quartarone et al. | |
| D613,063 | S | 4/2010 | Quartarone, III et al. | |
| D613,064 | S | 4/2010 | Quartarone, III et al. | |
| D613,065 | S | 4/2010 | McGuire et al. | |
| D613,066 | S | 4/2010 | McGuire et al. | |
| 7,905,349 | B2 | 3/2011 | Campbell | |
| D636,596 | S | 4/2011 | McGuire | |
| D649,353 | S | 11/2011 | Loudenslager et al. | |
| D649,354 | S | 11/2011 | Loudenslager et al. | |
| D649,355 | S | 11/2011 | Loudenslager et al. | |
| D649,356 | S | 11/2011 | Loudenslager et al. | |
| D669,266 | S | 10/2012 | Loudenslager et al. | |
| 8,752,798 | B2 | 6/2014 | Loudenslager | |
| D713,148 | S | 9/2014 | Bruce | |
| D715,055 | S | 10/2014 | Bruce et al. | |
| D718,534 | S | 12/2014 | Bruce | |
| 8,910,785 | B2 | 12/2014 | Loudenslager | |
| 9,421,608 | B2 | 8/2016 | Loudenslager et al. | |
| 11,065,516 | B2 * | 7/2021 | Pacha ..... | A63B 55/40 |
| 2003/0116456 | A1 * | 6/2003 | Ueno ..... | A63B 55/00 206/315.6 |
| 2008/0169210 | A1 | 7/2008 | Heidenreich | |
| 2010/0320106 | A1 | 12/2010 | McGuire | |
| 2012/0111747 | A1 | 5/2012 | Reimers | |
| 2017/0021241 | A1 | 1/2017 | Pelz | |

* cited by examiner

GOLF BAGS, GOLF BAG TOPS AND METHODS TO MANUFACTURE GOLF BAGS AND GOLF BAG TOPS

CROSS REFERENCE

This application is a continuation-in-part of U.S. patent application Ser. No. 17/348,991, filed Jun. 16, 2021, now U.S. Pat. No. 11,806,593, which is a continuation of U.S. patent application Ser. No. 16/216,736, filed Dec. 11, 2018, now U.S. Pat. No. 11,065,516, which claims the benefit of U.S. Provisional Application No. 62/607,387, filed Dec. 19, 2017.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

This application claims the benefit of U.S. Provisional Application No. 63/151,154, filed Feb. 19, 2021.

The disclosures of the referenced applications are incorporated herein by reference.

FIELD

The present disclosure generally relates to golf equipment, and more particularly, to golf bags, golf bag tops, and methods to manufacture golf bags and golf bag tops.

BACKGROUND

Golf bags may be used to carry golf clubs and accessories. Some golf bags may be tube-shaped to hold a set of golf clubs and include one or more pockets for holding balls, tees, gloves, rain gear, and other golf related equipment and accessories. The open top portion of a golf bag may be divided into a number of slots to allow an individual to organize and sort the golf clubs. Accordingly, an individual may organize his or her golf clubs based on available slots provided in the open top portion of the golf bag.

Figure 1:
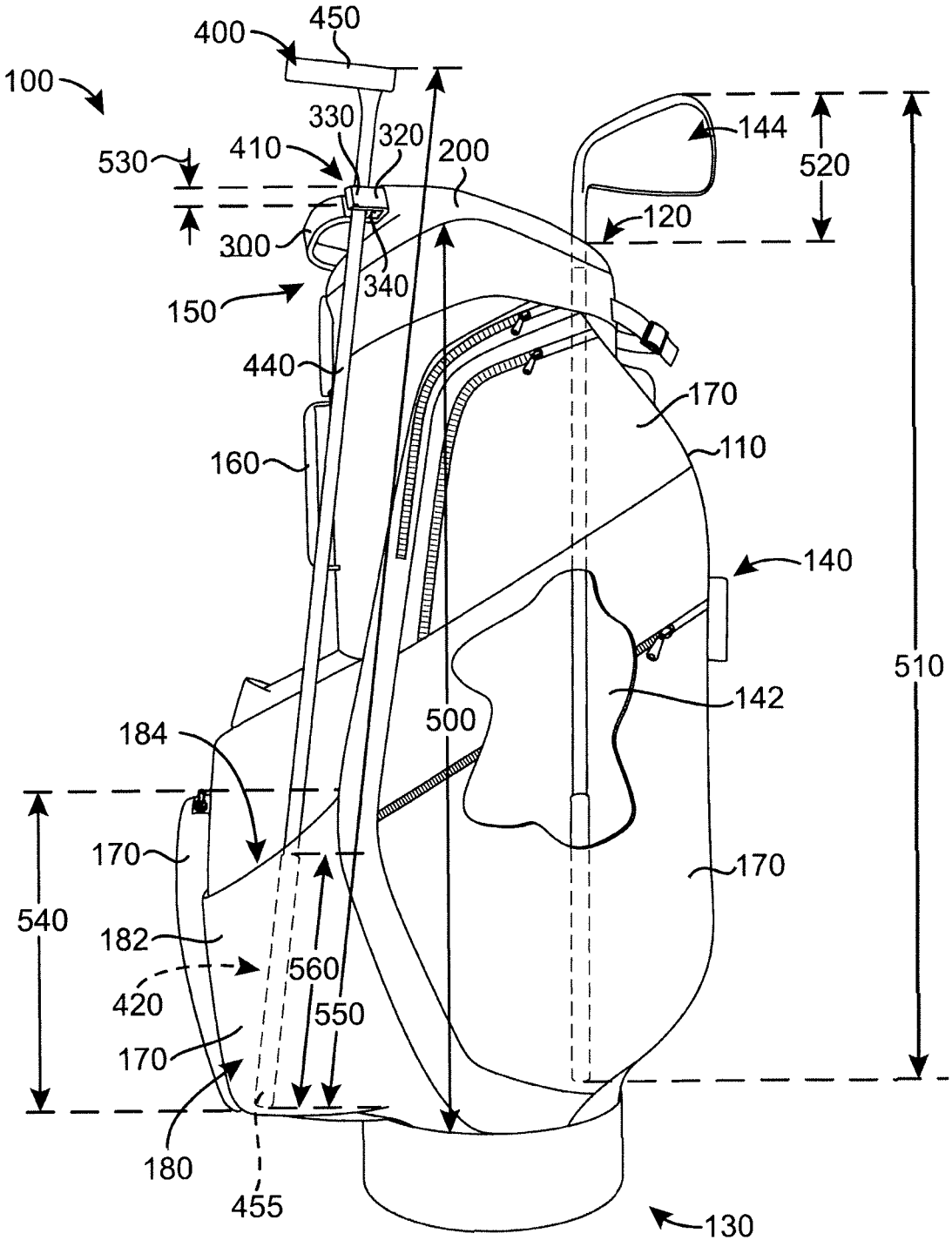
FIG. 1 depicts a side view of a golf bag with a golf bag top according to an exemplary embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf bag tops and methods to manufacture golf bag tops are described herein. The apparatus, methods, and articles of manufacture described herein are not limited in this regard.

In the example of FIG. 1, a golf bag 100 may include a body portion 110 having a top portion 120, a bottom portion 130, and a first housing portion 140 extending between the top portion 120 and the bottom portion 130. The first housing portion 140 may define a chamber portion 142 for holding and maintaining one or more golf clubs (e.g., one generally shown as 144) inside the body portion 110. Each of the one or more golf clubs may be any type of golf club such as, but not limited to, an iron-type golf club, a wood-type golf club, a hybrid-type golf club, or a putter-type golf club. Additionally, the golf club 144 may be part of a set of golf clubs. The apparatus, methods, and articles of manufacture described herein are not limited in this regard.

The golf bag 100 may include a second housing portion 150 located outside of the first housing portion 140. As described in detail below, the second housing portion 150 may enable one or more golf clubs (e.g., one generally shown as 400) to be prominently displayed and stored separately from any golf clubs stored in the first housing portion 140. The apparatus, methods, and articles of manufacture described herein are not limited in this regard.

The golf bag 100 may include one or more strap portions (not shown) so that an individual can lift and/or carry the golf bag 100. The golf bag 100 may include one or more golf bag handles (e.g., one generally shown as 160) on the body portion 110 between the top portion 120 and the bottom portion 130. The golf bag 100 may include one or more pockets (e.g., generally shown as 170) for carrying various items such as golf balls, golf tees, apparel, shoes, and/or other accessories. The pocket 170 may be accessible by any suitable types of closure (e.g., a zipper, hook and loop fastener, snap, etc.). The apparatus, methods, and articles of manufacture described herein are not limited in this regard.

In one example, as shown in FIGS. 1-9, the golf bag 100 may also include a golf bag top (e.g., described and shown as a club divider portion 200) located at or proximate to the top portion 120. The club divider portion 200 may have a shape, curvature, contour, and/or other physical characteristics as shown in the example of FIGS. 2-9 so as to fit on or inside the body portion 110 at or proximate to the top portion 120. The apparatus, methods, and articles of manufacture described herein are not limited in this regard.

Figure 2:
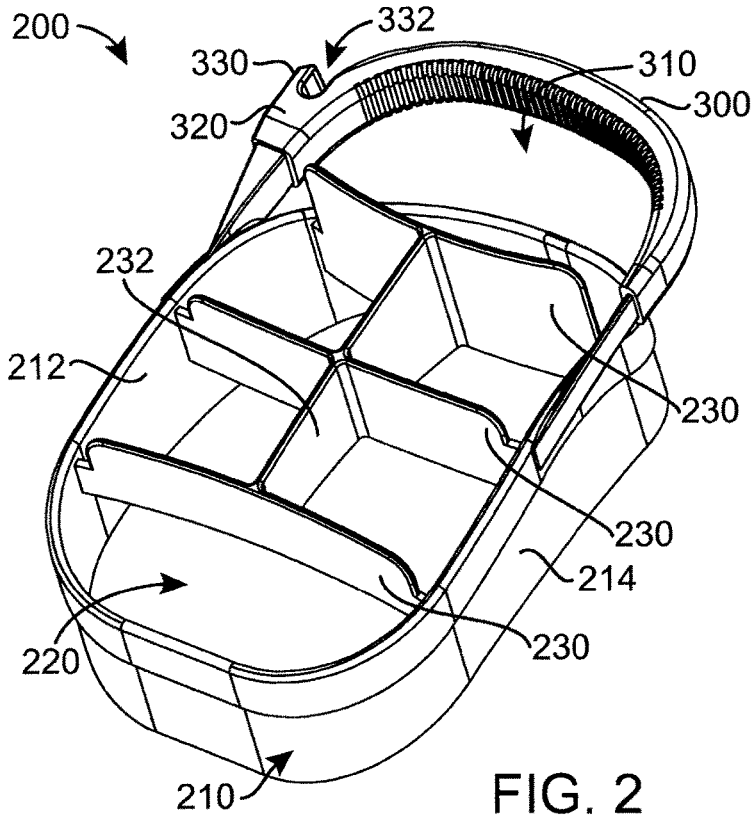
FIG. 2 depicts a top perspective view of a golf bag top according to an exemplary embodiment of the apparatus, methods, and articles of manufacture described herein.

The club divider portion 200 may include a divider body portion. The divider body portion may have a perimeter portion 210 having a first side 212 and a second side 214. The first side 212 may have an inner wall and an outer wall. The second side 214 may have an inner wall and an outer wall. As illustrated in FIG. 2, for example, the first side 212 and the second side 214 may correspond respectively to a left side and a right side of the perimeter portion 210. As shown in the example of FIGS. 2-9, the club divider portion 200 may include one or more interconnected rib portions 230 that may connect to the inner wall(s) of the perimeter portion 210 to define a plurality of openings 220 through which the one or more golf clubs 144 can be inserted into the first housing portion 140 of the golf bag 100. While the figures may depict a particular number of rib portions 230, the apparatus, methods, and article of manufacture described herein may include more or fewer rib portions (e.g., one rib portion or four rib portions). The rib portions 230 may each extend laterally between the first side 212 and the second side 214 and may be approximately parallel or nonparallel with each other. Additionally, the rib portions 230 may be interconnected by a spine portion 232 extending longitudinally between the rib portions 230. Although the above example may include the spine portion 232, the apparatus, methods, and articles of manufacture described herein may not include the spine portion 232 to interconnect the rib portions 230. In one example, the club divider portion 200 may include six openings, through which one or more golf clubs 144 may be inserted into the first housing portion 140. While the above example may describe a particular number of openings defined by the rib portion(s) 230, the apparatus, methods, and article of manufacture described herein may include more or fewer openings (e.g., one opening or eight openings) By providing a plurality of openings 220, a set of golf clubs may be separated into different groups to allow an individual to organize the golf clubs in a certain manner. Alternatively, the club divider portion 200 may not include any rib portions 230 and may be, for example, a single opening configured to receive one or more golf clubs. The apparatus, methods, and articles of manufacture described herein are not limited in this regard.

The golf bag 100 may include a handle portion 300 coupled to the perimeter portion 210 of the club divider portion 200. In one example, the handle portion 300 may be a separate piece coupled to the club divider portion 200 via any suitable manufacturing method or process (e.g., adhered with epoxy, fastened with screws or threaded fasteners, or any combination thereof). In another example, the handle portion 300 and the club divider portion 200 may be a unitary piece (e.g., the handle portion 300 may be an integral piece of the club divider portion 200). The handle portion 300 may be coupled at one end to the first side 212 of the perimeter portion 210, extend outward and around a front portion of the perimeter portion 210, and be coupled at another end to the second side 214 of the perimeter portion 210. Accordingly, the handle portion 300 may extend outside of the perimeter portion 210 and may be spaced apart from the perimeter portion 210 to define a handle opening 310. In use, an individual may insert their hand through the handle opening 310 and then wrap their fingers around the handle portion 300 to use the handle portion 300 to lift and/or carry the golf bag 100. In some examples, the handle portion 300 may include texturing to improve grip. The apparatus, methods, and articles of manufacture described herein are not limited in this regard.

The handle portion 300 may include a club fastener portion 320 configured to engage a first shaft portion 410 of the golf club 400. The club fastener portion 320 may be located at or proximate to either the first side 212 or the second side 214 of the perimeter portion 210. The golf bag 100 may include a base portion 180 located at or proximate to the bottom portion 130 and configured to engage a second shaft portion 420 of the golf club 400. The club fastener portion 320 and the base portion 180 may engage the golf club 400 at two spaced apart portions (e.g., the first shaft portion 410 and the second shaft portion 420) to fasten or hold the golf club 400 in an inverted position. In one example, as shown in FIG. 1, the base portion 180 may be a pocket configured to receive the second shaft portion 420 of the golf club 400. In another example (not shown), the base portion 180 may be a sleeve portion, a tube portion, a platform portion, a cup-shaped portion, a channel portion, or any other receiving means configured to receive and hold the second shaft portion 420 of the golf club 400. It should be understood that any suitable type of receiving means may be utilized. The club fastener portion 320 and the base portion 180 may define the second housing portion 150 for housing one or more golf clubs. In the example of FIG. 1, the second housing portion 150 is shown to house one golf club 400. The second housing portion 150 may separate and externally store and/or display a single golf club of a set of golf clubs stored in the first housing portion 140. In one example, the second housing portion 150 may hold a putter-type golf club. In another example (not shown), the second housing portion 150 may include multiple club fastener portions (not shown) that cooperate with the base portion 180 or several base portions (not shown) to house more than one golf club. Alternatively, the base portion 180 may include one or more rib portions to provide two or more separate openings, channels, chambers, or compartments. The apparatus, methods, and articles of manufacture described herein are not limited in this regard.

The first housing portion 140 may define the chamber portion 142 and/or other interior space of the golf bag 100 to hold one or more golf clubs. When a golf club is received in the first housing portion 140, the golf club 400 may have an exposed club length 520 that extends above the top portion 120. The exposed club length 520 of the golf club 144 may include a golf club head and a shaft portion of the golf club 144. During play, an individual can view the exposed club length 520 of the golf club 144 including at least the golf club head to visually differentiate the golf club from any other golf club(s) contained by the first housing portion 140. The first housing portion 140 may extend between the top portion 120 and the bottom portion 130. The first housing portion 140 may extend from the top portion 120 to the bottom portion 130. The first housing portion 140 may have a height 500 that is greater than a percentage of a length of one or more golf clubs contained by the first housing portion 140. In one example, the height 500 of the first housing portion 140 may be greater than 50% of a maximum club length 510 of the golf club 144. In another example, the height 500 of the first housing portion 140 may be greater than 60% of the maximum club length 510 of the golf club 144. In yet another example, the height 500 of the first housing portion 140 may be greater than 70% of the maximum club length 510 of the golf club 144. In yet another example still, the height 500 of the first housing portion 140 may be greater than 80% of the maximum club length 510 of the golf club 144. Accordingly, the chamber portion 142 may be an elongated and substantially enclosed hollow internal space of the golf bag 100 for surrounding more than 50% of the club length of one or more golf clubs. The apparatus, methods, and articles of manufacture described herein are not limited in this regard.

The second housing portion 150 have a height that may be defined by summing a height 530 of the club fastener portion 320 and a height 540 of the base portion 180. The height of the second housing portion 150 may be less than or equal to a percentage of a maximum club length of one or more golf clubs housed by the second housing portion 150. For example, the height of the second housing portion 150 may be less than or equal to 50% of a maximum club length 550 of the golf club 400. In another example, the height of the second housing portion 150 may be less than or equal to 60% of the maximum club length 550 of the golf club 400. In another example, the height of the second housing portion 150 may be less than or equal to 70% of the maximum club length 550 of the golf club 400. In another example, the height of the second housing portion 150 may be less than or equal to 80% of the maximum club length 550 of the golf club 400. While the above examples may describe particular percentages, the apparatus, methods, and articles of manufacture described herein may include the second housing portion 150 having a height to engage a greater percentage or a lesser percentage of the maximum club length 550 of the golf club 400. Accordingly, when the golf club 400 is stored or held in the second housing portion 150, a portion of the maximum club length 550 of the golf club 400 may be exposed. More specifically, a portion of the golf club 400 other than the first shaft portion 410 and the second shaft portion 420 of the golf club 400 may be exposed. Thus, for a particular golf club, more than 50% of its maximum club length may be housed by the first housing portion 140. When the same club is instead housed by the second housing portion 150, less than or equal to 50% of its maximum club length may be housed by the second housing portion 150. As a result, the golf club 144 housed by the first housing portion 140 may have less exposed length than the golf club 400 housed by the second housing portion 150. Advantageously, by having more exposed length, the golf club 400 secured by the second housing portion 150 may be more prominently displayed than the golf club 144 stored in the first housing portion 140. Additionally, the golf club 400 may be easily handled due to more exposed surface area in which to grab the golf club 400 and remove the golf club from the second housing portion 150. What's more, the second housing portion 150 may be located frontward on the golf bag 100 such that the golf club 400 is readily accessible during play when the golf bag 100 is secured to a golf cart or placed on the ground. Accordingly, an individual may elect to use the second housing portion 150 to secure his or her most frequently used golf club and/or to prominently display his or her favorite golf club. The foregoing features are not available in present golf bags. The apparatus, methods, and articles of manufacture described herein are not limited in this regard.

Figure 3:
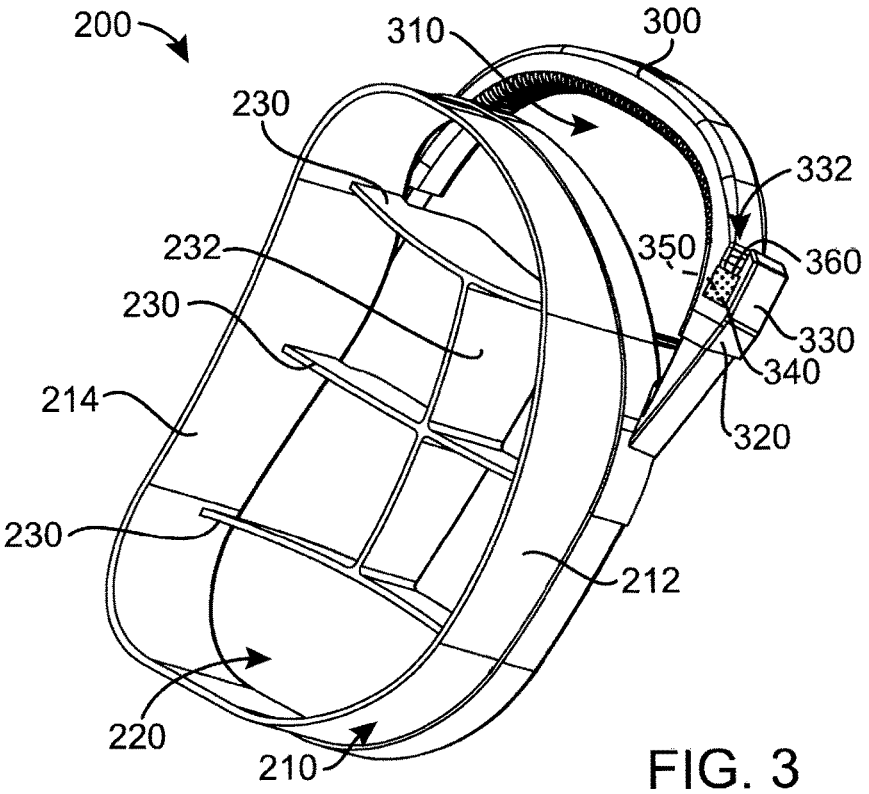
FIG. 3 depicts a bottom perspective view of the golf bag top of FIG. 2.
Figure 4:
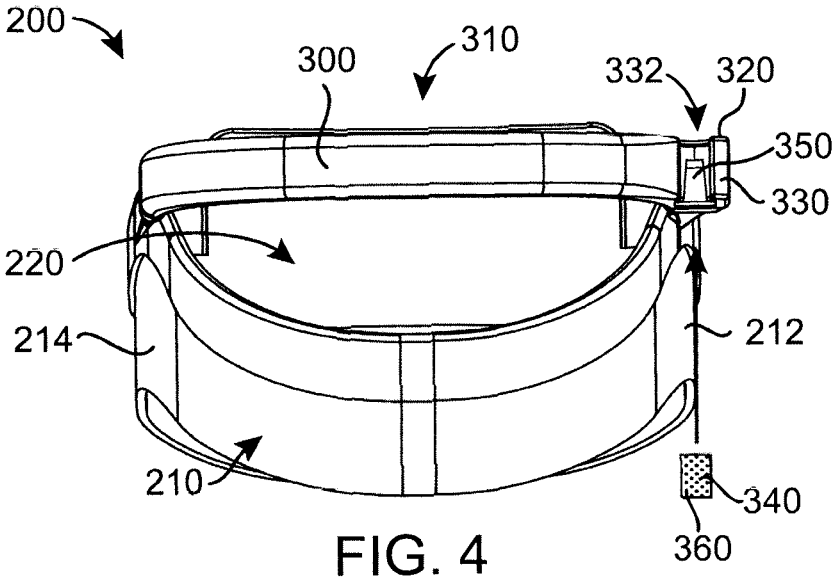
FIG. 4 depicts a front view of the golf bag top of FIG. 2.
Figure 5:
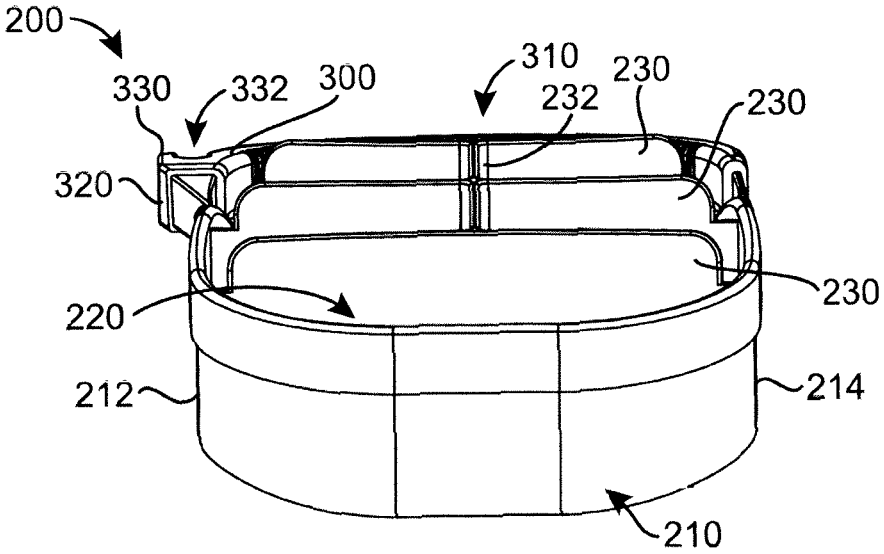
FIG. 5 depicts a rear view of the golf bag top of FIG. 2.

The club fastener portion 320 may include any suitable type of fastening mechanism configured to engage and hold a shaft 440 of the golf club 400 (e.g., via the first shaft portion 410). In the example shown in FIGS. 1-9, the club fastener portion 320 may include a U-shaped portion 330. The U-shaped portion 330 may have a first arm portion 331, a second arm portion 333, and an arcuate portion 334 connecting the first arm portion 331 to the second arm portion 333. The U-shaped portion 330 may define a space 332. The U-shaped portion may have a mouth portion 337 that provides access to the space 332. The space 332 may have a width that is greater than or equal to an outer diameter of the shaft 440 of the golf club 400. In one example, the outer diameter of the shaft 440 at or proximate to a grip portion 455 (e.g., butt end of the shaft 440) may be in a range of 0.58 inch to 0.64 inch. The outer diameter of the shaft 440 at or proximate to the club head of the golf club 400 (e.g., tip end of the shaft 440) may be in a range 0.335 inch to 0.37 inch. The diameter of the shaft 440 may taper between the butt end of the shaft and the opposing end of the shaft that is connected to the golf club head. While the above examples may describe particular outer diameters, the apparatus, methods, and articles of manufacture described herein may include shafts with greater or smaller diameters. Accordingly, the first shaft portion 410 or other shaft portion of the golf club 400 may be inserted into the U-shaped portion 330. To hold the first shaft portion 410 of the golf club 400 in the U-shaped portion 330, the club fastener portion 320 may include a magnetic portion 340 located inside the U-shaped portion 330. Accordingly, the first shaft portion 410 or other shaft portion of the golf club 400 may be magnetically attracted to the magnetic portion 340 and thereby secure the shaft within the space 332 of the U-shaped portion 330. Referring to FIGS. 3, 4, and 7, for example, the magnetic portion 340 may be inserted inside a cavity 350 in the bottom portion of the club fastener portion 320. The cavity 350 may be located on an underside 321 of the club fastener portion 320. The cavity 350 may be open to the space 332 defined by the U-shaped portion 330 such that an outer portion 360 of the magnetic portion 340 is exposed to the space 332 and is free to contact the first shaft portion 410 of the golf club 400. The magnetic portion 340 may be sized and shaped to complement the cavity 350 so as to allow the magnetic portion 340 to be easily received inside the cavity 350 and secured thereto via a friction fit, an adhesive, or a fastener. The magnetic portion 340 may entirely or partially occupy the cavity 350. In other examples, the magnetic portion 340 may have a circular cross section, a square cross section, a rectangular cross section, or any other suitable shape to engage the shaft 440 of the golf club 400. The magnetic portion 340 may be removable and replaceable with a magnetic portion having a weaker or stronger magnetic attraction, thereby allowing an individual to adjust the amount of magnetic attraction between the club fastener portion 320 and the shaft 440 to match personal preference and use. The apparatus, methods, and articles of manufacture described herein are not limited in this regard.

While the above examples may describe the magnetic portion 340 as a separate piece, the magnetic portion 340 may be an integral portion of the club fastener portion 320.

In one example, the club fastener portion 320 may be made of or include material(s) with magnetic properties to engage and secure a shaft of the golf club 400 (i.e., the shaft may be made of metal material(s)). Alternatively, the club fastener portion 320 may include the U-shaped portion without the magnetic portion 340 and engage the shaft 440 of the golf club 400 with a mechanical lock only. Further, while the figures may depict the club fastener portion 320 as a portion of the handle portion 300, the club fastener portion 320 may extend directly from the club divider portion 200 (e.g., extend from the perimeter portion 210) or from any other portion of the golf bag 100. The apparatus, methods, and articles of manufacture described herein are not limited in this regard.

An individual may easily store and retrieve a golf club from the second housing portion 150. For example, the second shaft portion 420 of the golf club 400 may be inserted into the base portion 180 and then the golf club 400 may be guided toward the club fastener portion 320 in a substantially horizontal direction of insertion so that the first shaft portion 410 of the golf club 400 is received in the U-shaped portion 330 and held in place by the magnetic portion 340. To remove the golf club 400 from the second housing portion 150, the golf club 400 may be pulled away from the club fastener portion 320 in a substantially horizontal direction of removal and with sufficient force to disengage the first shaft portion 410 of the golf club 400 from the magnetic portion 340. The second shaft portion 420 may be removed from the base portion 180 by lifting the golf club 400 in an upward direction. As described herein, the handle portion 300 extends outward and around a part of the perimeter portion 210. Accordingly, the outward location of the handle portion 300 relative to the top portion 120 of the body portion 110 separately locates the golf club 400 from other golf clubs and allows for easy access and use by the individual. In one example, the second housing portion 150 may be used to separate a putter-type golf club from the iron-type golf club(s), the wood-type golf club(s), the hybrid-type golf club(s), or the wedge-type golf club(s) stored in the first housing portion 140. The apparatus, methods, and articles of manufacture described herein are not limited in this regard.

In one example, as shown in FIG. 1, the base portion 180 may include an external pocket 182 of the golf bag 100. The external pocket 182 may be located at or near the bottom portion 130. The external pocket 182 may include an opening 184, through which the second shaft portion 420 or other portion of the golf club 400 may be inserted. The opening 184 may be freely accessible or accessed via a closure (e.g., zipper, Velcro®, button, etc.). In one example, as shown in FIG. 1, the club fastener portion 320 may engage the first shaft portion 410 of the golf club 400, which may be a portion of the shaft 440 of the golf club 400 that is closer to a golf club head 450 than to the grip portion 455 of the golf club 400. The external pocket 182 may receive the second shaft portion 420 of the golf club 400, which may be a portion of the shaft 440 of the golf club 400 that includes the grip portion 455. In one example, as shown in FIG. 1, the height 540 of the base portion 180 may be greater than or equal to a maximum length 560 of the grip portion 455 of the golf club 400. In one example, the maximum length 560 of the grip portion 455 may be 10 inches. Although the above example describes a particular length of the grip portion 455, the apparatus, methods, and articles of manufacture described herein may include grip portions with greater or shorter lengths. Additionally, the height 540 of the base portion 180 may be less than or equal to 50% of the maximum club length 550 of the golf club 400. In another example (not shown), the height 540 of the base portion 180 may be less than the maximum length 560 of the grip portion 455 of the golf club 400. In one example, the particular height 540 of the base portion 180 may be determined based on an individual's desire to shield the grip portion 455 or to prominently display the grip portion 455. The apparatus, methods, and articles of manufacture described herein are not limited in this regard.

The maximum club length 550 of the golf club 400 may vary based on the type of golf club and/or an individual's preference (e.g., in the range of 30 inches to 60 inches). In one example, the maximum club length 550 of a driver-type golf club may be in a range of 45 inches to 60 inches. In another example, the maximum club length 550 of a fairway wood-type golf club may be in a range of 43 inches to 45 inches. In yet another example, the maximum club length 550 of a hybrid-type golf club may be in a range of 42 inches to 44 inches. The maximum club length 550 of an iron-type golf club may be in a range of 36 inches to 41 inches. The maximum club length 550 of a wedge-type golf club may be in a range of 35 inches to 37 inches. The maximum club length 550 of a putter-type golf club may be in a range of 32 inches to 36 inches. In one example, the maximum club length 550 of the golf club 400 may be limited by a governing body of golf such as, but not limited to, the United States Golf Association (USGA). At present, the USGA requires the club length of a golf club to be at least 18 inches and, with the exception of putters, no more than 48 inches. With respect to the present disclosure, the "maximum club length" of a particular club may correspond to a straight-line measurement taken down the shaft beginning from the top of the grip portion to where the golf club meets the ground while the golf club is at an address position. While the above examples may describe particular lengths of certain types of golf clubs, the apparatus, methods, and articles of manufacture described herein may include golf clubs with greater or shorter club lengths. The apparatus, methods, and articles of manufacture described herein are not limited in this regard.

In one example, as shown in FIG. 1, the base portion 180 may be located more forward than the club fastener portion 320. In other words, the base portion 180 may be horizontally offset relative to the club fastener portion 320. Further, the pocket 182 of the base portion 180 and the U-shaped portion 330 of the club fastener portion 320 may be generally located on the same vertical plane or substantially on the same vertical plane. In this way, the golf club 400 may be held in an upright position with a slight tilt toward the first housing portion 140, as shown in FIG. 1. In another example (not shown), the base portion 180 and the club fastener portion 320 may have no horizontal offset therebetween such that the golf club 400 may be held in an upright orientation with no tilt. When the grip portion 455 of the golf club 400 is inserted into the pocket 182 and then the first shaft portion 410 of the golf club 400 is moved toward the magnetic portion 240, the pocket 182 may guide the shaft 440 of the golf club 400 toward the U-shaped portion 330 with minimal or no lateral pivot. In other words, the second shaft portion 420 that is engaged inside the pocket 182 may be encouraged to move inside the pocket 182 toward the U-shaped portion 330 while the pocket 182 prevents or substantially prevents any lateral pivot of the golf club 400. Additionally, the golf club 400 may tend to pivot toward the magnetic portion 340 due to the noted horizontal offset between the pocket 182 and the club fastener portion 320. Accordingly, when an individual inserts the second shaft portion 420 of the golf club 400 into the pocket 182, the golf club 400 may pivot toward the club fastener portion 320, enter the U-shaped portion 330, and engage the magnetic portion 340 with minimal effort from the individual. The apparatus, methods, and articles of manufacture described herein are not limited in this regard.

The golf bag 100 may be manufactured by any suitable manufacturing method and with any suitable materials. The golf bag 100 may include a rigid frame or shell that may be covered in soft materials such as leather, canvas, nylon, plastic, metal, composite materials, and/or other materials. The golf bag 100 may include any number of rings, clips, clamps, etc., to allow attachment of various straps and/or accessories. The golf bag 100 may include one or more pockets. The base portion 180 may be configured (i.e., sized, shaped, etc.) to engage the second shaft portion 420 of the golf club 400 and positioned to be aligned (e.g., vertical planar alignment) with the U-shaped portion 330 as described herein. The base portion 180 may include an elastic material or be generally elastic to grip the second shaft portion 420 of the golf club 400. The apparatus, methods, and articles of manufacture described herein are not limited in this regard.

In one example, the club divider portion 200 may be manufactured from rigid plastic materials via injection molding. The perimeter portion 210, the rib portions 230, and the spine portion 232 may be manufactured as a unitary piece via injection molding. In another example, the rib portions 230 and the spine portion 232 may be separately manufactured and then joined to the perimeter portion 210. In one example, the handle portion 300 may be separately manufactured by injection molding or other plastic manufacturing methods and attached to the perimeter portion 210. The apparatus, methods, and articles of manufacture described herein are not limited in this regard.

The magnetic portion 340 may be attached inside the cavity 350 of club fastener portion 320. The magnetic portion 340 may be attached inside the cavity 350 of club fastener portion 320 by way of friction and/or an adhesive. In another example, where the magnetic portion 340 is embedded in the club fastener portion 320, the club fastener portion may be injection molded around the magnetic portion, thereby partially or entirely encapsulating the magnetic portion. The apparatus, methods, and articles of manufacture described herein are not limited in this regard.

The club divider portion 200 may be manufactured from any suitable type of plastic materials, metal, metal alloy, composite material, wood, and/or any other material. In one example, the club divider portion 200 may be attached to the body portion 110 of the golf bag 100 by rivets. In another example, the club divider portion 200 may be attached to the body portion 110 of the golf bag 100 by threaded fasteners. In another example, the club divider portion 200 may be attached to the body portion 110 of the golf bag 100 by an adhesive. In another example, the club divider portion 200 may be attached to the body portion 110 of the golf bag 100 by screws. In another example, the club divider portion 200 may be attached to the body portion 110 of the golf bag 100 by an interference fit. The apparatus, methods, and articles of manufacture described herein are not limited in this regard.

Figure 6:
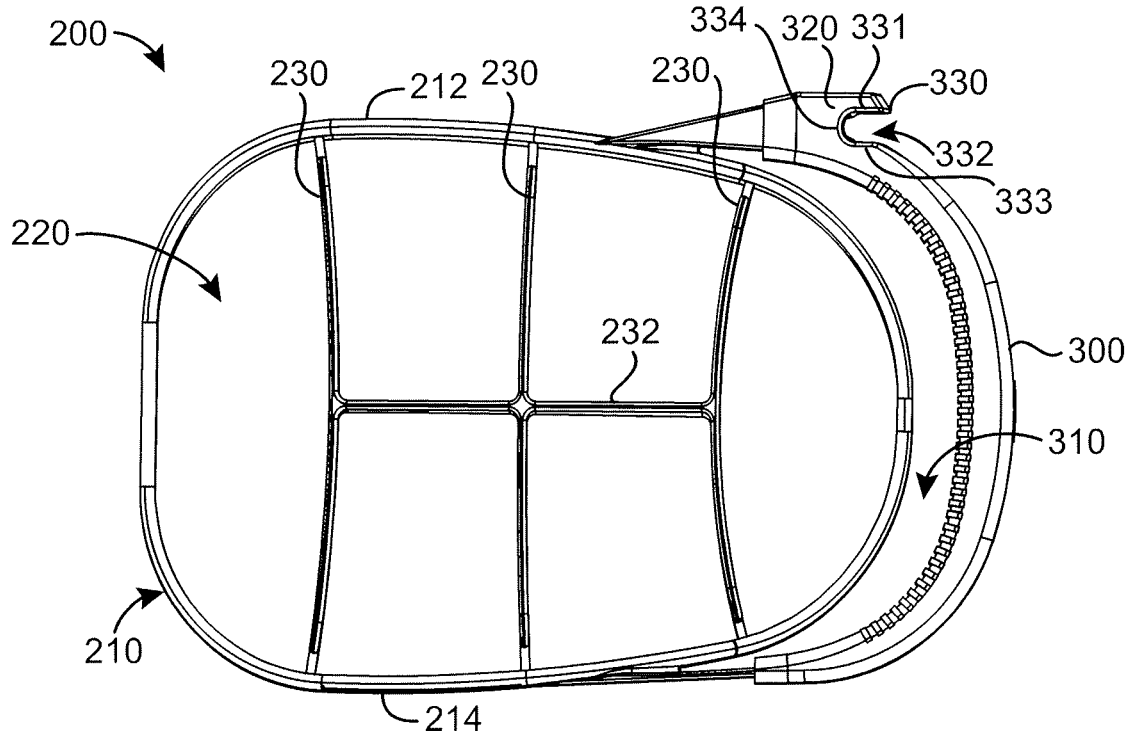
FIG. 6 depicts a top view of the golf bag top of FIG. 2.
Figure 7:
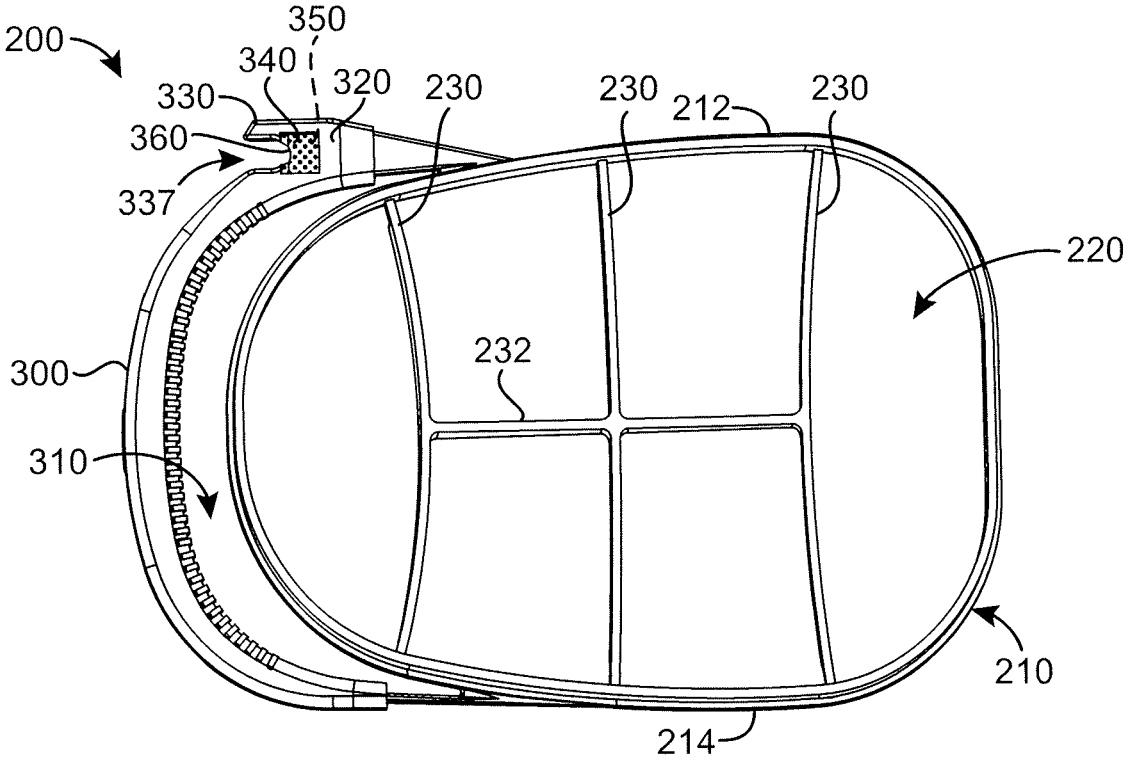
FIG. 7 depicts a bottom view of the golf bag top of FIG. 2.
Figure 8:
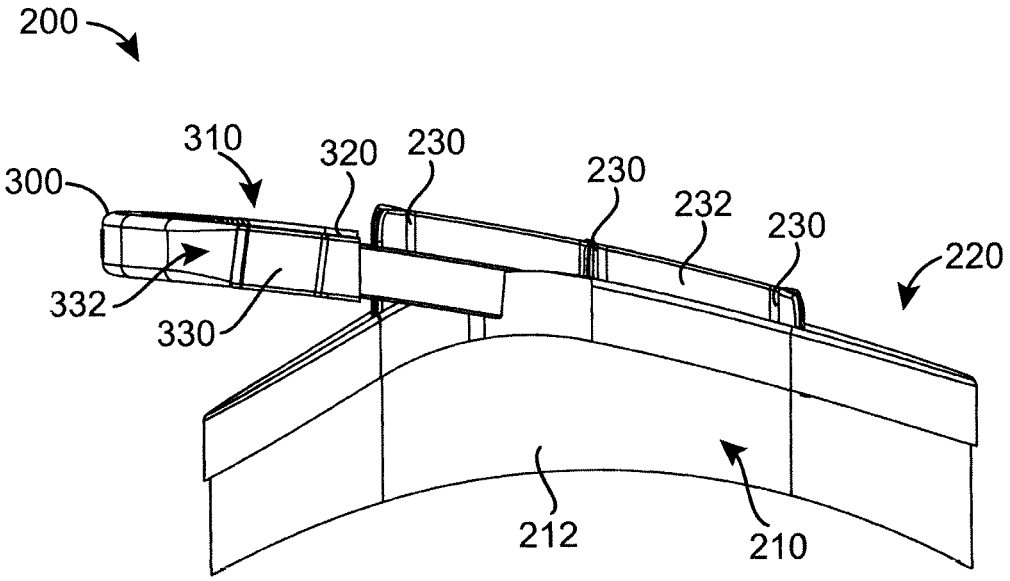
FIG. 8 depicts a right-side view of the golf bag top of FIG. 2.
Figure 9:
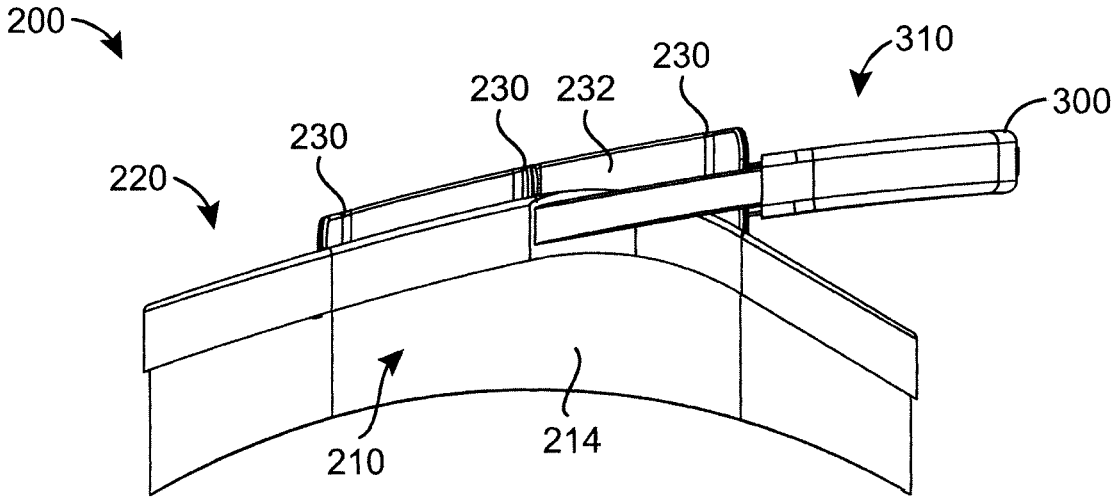
FIG. 9 depicts a left-side view of the golf bag top of FIG. 2.

As shown in FIG. 6, a first end of the handle portion 300 may be coupled to a first outer wall of the first side 212 of the perimeter portion 210, and a second end of the handle portion 300 may be coupled to a second outer wall of the second side 214 of the perimeter portion 210. Between the first end and the second end of the handle portion 300, the handle portion 300 may extend outward and around a portion of the perimeter portion 210. Accordingly, part of the handle portion 300 may extend outside of and be spaced apart from the perimeter portion 210. Likewise, the club fastener portion 320 may be located outside of and be spaced apart from the perimeter portion 210, as shown in FIG. 6. The club fastener portion 320 may be spaced apart from an exterior material of the first housing portion 140. Spacing the club fastener portion 320 outward and away from the perimeter portion 210 and the first housing portion 140 may prevent the golf club shaft 440 from rubbing on an exterior surface of the golf bag 100 during travel (e.g., in a motorized golf cart or pull cart) and causing unwanted wear to the golf bag 100 or golf club shaft 440. In one example, the U-shaped portion 330 may be spaced apart from the perimeter portion 210 by at least 0.5 inch (12.7 mm). In another example, the U-shaped portion 330 may be spaced apart from the perimeter portion 210 by at least 1 inch (25.4 mm). In another example, the U-shaped portion 330 may be spaced apart from the perimeter portion 210 by at least 2 inches (25.4 mm). In yet another example, the U-shaped portion 330 may be spaced apart from the perimeter portion 210 by at least one shaft diameter. In yet another example, the U-shaped portion 330 may be spaced apart from the perimeter portion 210 by at least two shaft diameters. The apparatus, methods, and articles of manufacture described herein are not limited in this regard.

The golf bag top or the club divider portion 200 may be used for any type of golf bag and may not be limited for use with any of the golf bags described herein. The club divider portion 200 may be manufactured to fit any type and size of golf bag. The golf bag top or the club divider portion 200 may then be attached at or near the top portion of a golf bag to provide the functions discussed herein in combination with one more pockets (i.e., base portion) of the golf bag at or near the bottom portion of the golf bag. The apparatus, methods, and articles of manufacture described herein are not limited in this regard.

The club fastener portion 320 may be an integral part of the handle portion 300, as shown in FIG. 6. Consequently, the presence and purpose of the club fastener portion 320 may not be readily apparent to an individual. To identify the club fastener portion 320 and alert the individual of its presence, the club fastener portion 320 may be a different color than a color of the handle portion 300. The magnet cover portion 600 may be a different color (e.g., red) than the color of the handle portion 300 (e.g., black). Adding a dissimilar color to the club fastener portion 320 and/or magnet cover portion 600 may draw attention to those features and enhance the objective of prominently displaying an individual's favorite golf club outside the first housing portion 140. The apparatus, methods, and articles of manufacture described herein are not limited in this regard.

Although the club fastener portion 320 is shown as an integral part of the handle portion 300, this is not limiting. In another example, the club fastener portion 320 may be located on and attached to an exterior surface of the first housing portion 140. In another example, the club fastener portion 320 may be a removable club fastener portion that is configured to attach to an exterior surface of the golf bag. In yet another example, the club fastener feature may include a first removable club fastener portion attachable to an upper portion of the first housing portion 140 and a second removable club fastener attachable to a lower portion of the first housing portion 140. In yet another example, the club fastener feature may include a first removable club fastener portion attachable to a top portion 120 of the first housing portion 140 and a second removable club fastener attachable to the bottom portion 130 of the golf bag 100. The removable club fasteners may attach to the golf bag 100 or any golf bag with fasteners, magnets, adhesives, or any other suitable technique. The apparatus, methods, and articles of manufacture described herein are not limited in this regard.

Figure 10:
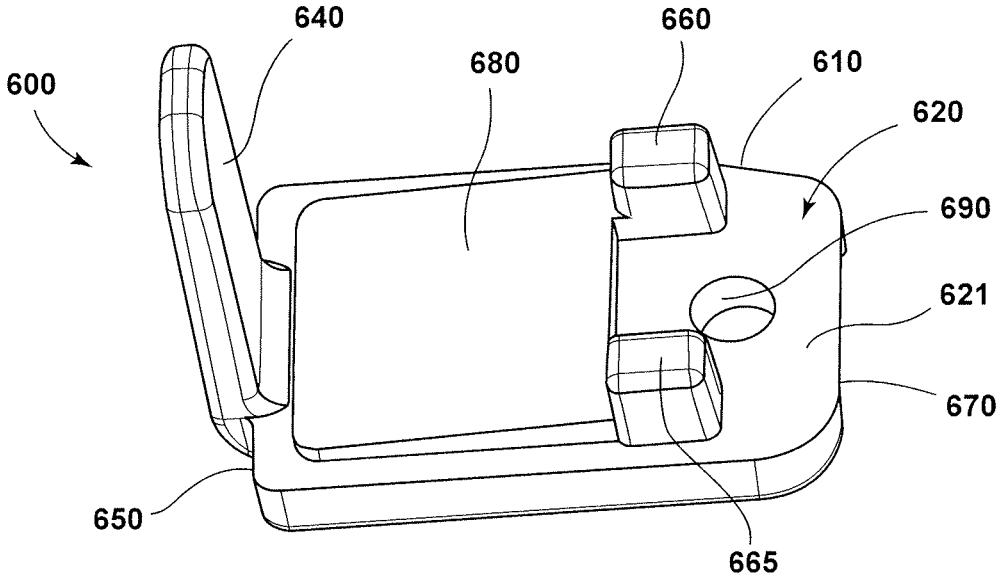
FIG. 10 depicts a top perspective view of a magnet cover according to an exemplary embodiment of the apparatus, methods, and articles of manufacture described herein.
Figure 11:
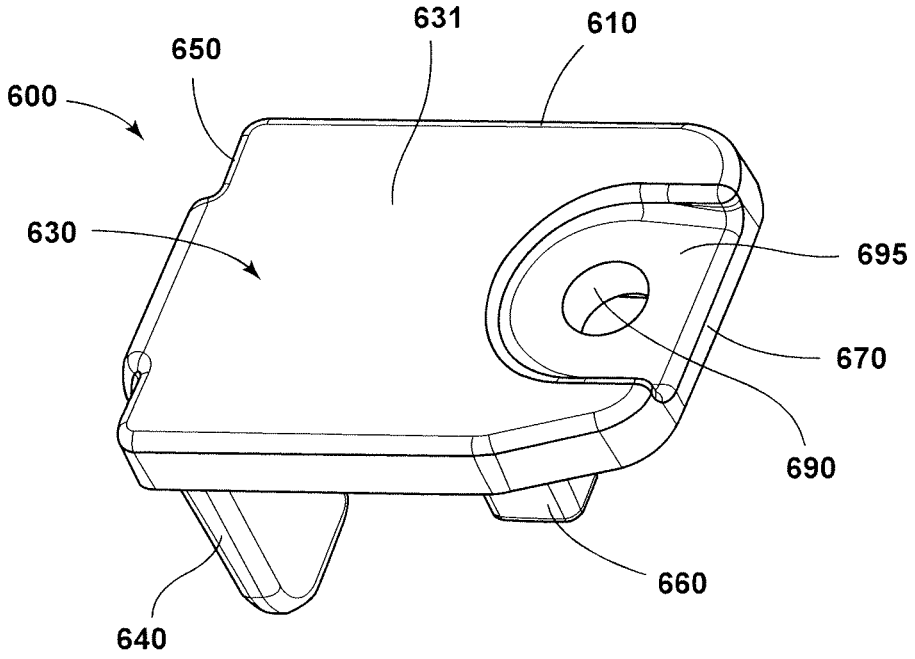
FIG. 11 depicts a bottom perspective view of the magnet cover of FIG. 10.

In one example, as illustrated in FIGS. 10 and 11, a magnet cover portion 600 is shown adapted to cover the magnetic portion 340. The magnet cover portion 600 may have a body portion 610 having a top portion 620 and a bottom portion 630. The magnet cover portion 600 may have a tongue-shaped flap portion 640 extending from the body portion 610 at or proximate a first end 650 of the body portion 610. The flap portion 640 may be configured to entirely or partially cover the outer portion 360 of the magnetic portion 340 that is exposed to the space 332 defined by the U-shaped portion 330 of the club fastener portion 320. The flap portion 640 may be cantilevered from the first end 650 and may extend orthogonally or substantially orthogonally relative to the top portion 620 of the body portion 610, as shown in FIG. 10. In one example, the body portion 610 may be made from a first material (e.g., polycarbonate), and the flap portion 640 may be made from a second material (e.g., thermoplastic elastomer) that is softer and more elastic than the first material. In another example, the body portion 610 and the flap portion 640 may be made from the same material. The body portion 610 and the flap portion 640 may be a unitary piece. Alternately, the body portion 610 and the flap portion 640 may be separate pieces joined together to form the magnet cover portion 600. The apparatus, methods, and articles of manufacture described herein are not limited in this regard.

The magnet cover portion 600 may protect the shaft from being scratched or marred by the magnetic portion. The magnet cover portion 600 may attenuate sound produced when inserting the shaft into the club fastener portion 320. Accordingly, the magnet cover portion 600 may be made from a softer material (i.e., having a lower material hardness value) than the ferromagnetic material of the magnetic portion 340. In one example, the magnet cover portion 600 may be made from a synthetic material such as plastic or carbon fiber. In another example, the magnet cover portion 600 may be made from a natural material such as wood, leather, rubber, or cork. In yet another example, the flap portion 640 of the magnet cover portion 600 may be made of a conformable material that can be adapted to receive a range of shaft diameters. The magnet cover portion 600 may experience wear over time and, therefore, may be removable and replaceable. The apparatus, methods, and articles of manufacture described herein are not limited in this regard.

Figure 13:
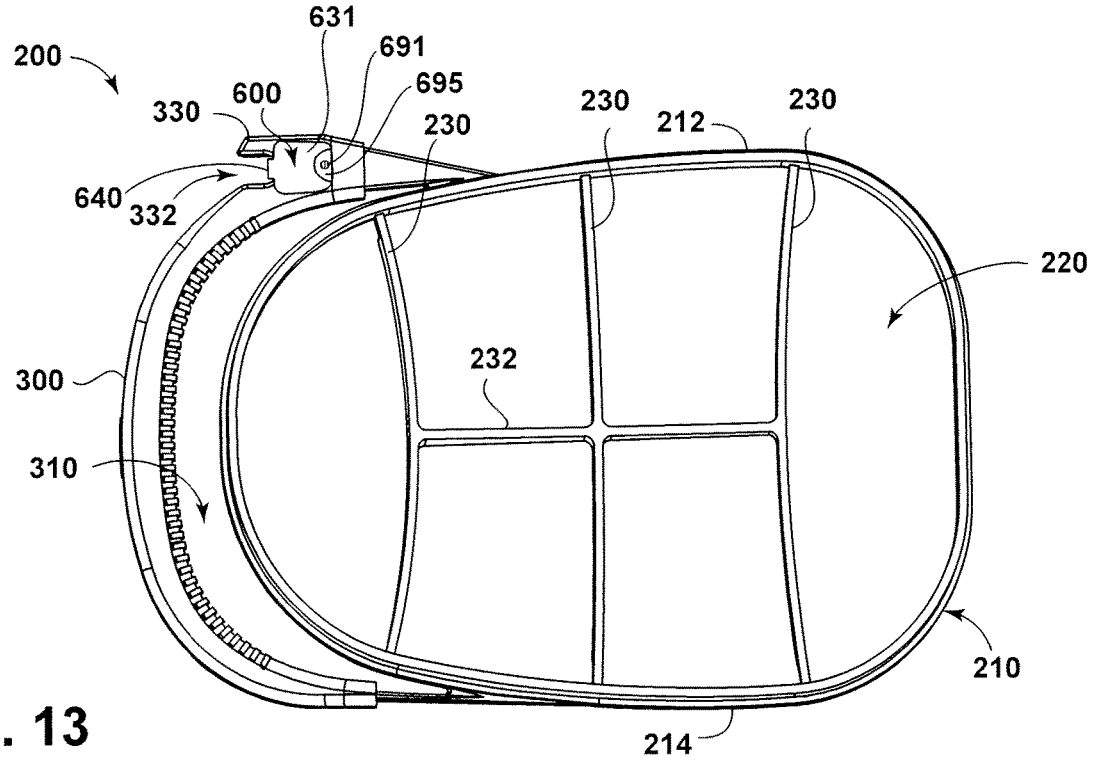
FIG. 13 depicts a bottom view of the golf bag top of FIG. 12 with the magnet cover of FIG. 10 installed thereon.

The magnet cover portion 600 may include one or more locating features to aid installation and alignment of the magnet cover portion 600. Examples of locating features include, but are not limited to, bosses, shims, pockets, depressions, locating pins, and threaded holes. The magnet cover portion 600 may include one or more bosses exemplarily shown as a first boss 660 and a second boss 665 in FIGS. 10 and 11. In one example, the first boss 660 and second boss 665 may protrude from a top surface 621 of the top portion 620 and may extend in the same or substantially the same direction as the flap portion 640. The first boss 660 and second boss 665 may be located at or proximate to a second end 670 of the body portion 610. In the illustrated example, the first boss 660 and second boss 665 may be spaced apart in a lateral direction across the top portion 620. Alternatively, the first boss 660 and second boss 665 may be spaced apart in a longitudinal direction or other directions across the top portion 620. The first boss 660 and second boss 665 may be connected to or separated from a shim portion 680 located on the top portion 620. In one example, the shim portion 680 may be located between the flap portion 640 and the first and second bosses 660 and 665. The shim portion 680 may be configured to fit inside the cavity 350 on the underside 321 of the club fastener portion 320 and may abut the magnetic portion 340 housed inside the cavity 350. The shim portion 680 may have a constant or variable height relative to the top surface 621 of the top portion 620. In one example, the shim portion 680 may have a tapered height. In the illustrated example, the shim portion 680 may gradually increase in height in a direction toward the first and second bosses 660 and 665. A through-hole 690 may be formed through the body portion 610 proximate to the second end 670. The through-hole 690 may be located equidistant from the first and second bosses 660 and 665. The through-hole 690 may be located closer to the second end 670 than the first and second bosses 660 and 665. A recess 695 may be provided on the bottom portion 630 to allow a threaded fastener 691 to be inserted through the through-hole 690 and a head of the fastener to be flush with a bottom surface 631 of the bottom portion 630, as shown in FIG. 13. The apparatus, methods, and articles of manufacture described herein are not limited in this regard.

Figure 12:
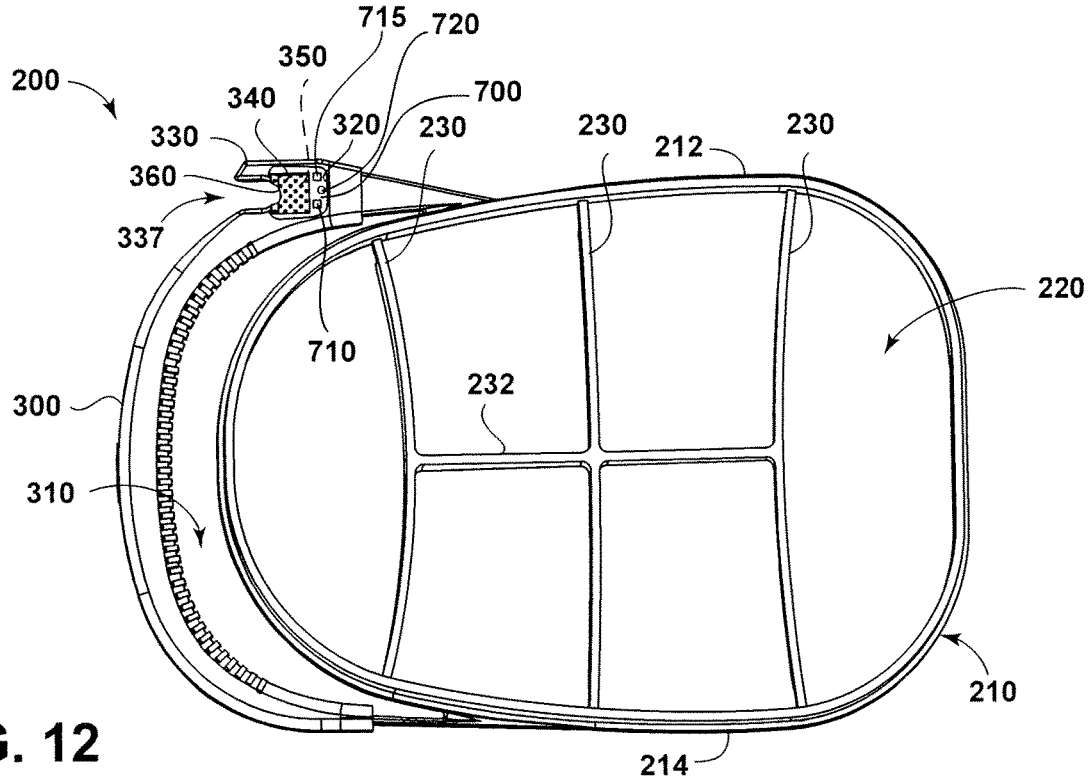
FIG. 12 depicts a bottom view of a golf bag top according to an exemplary embodiment of the apparatus, methods, and articles of manufacture described herein.
Figure 14:
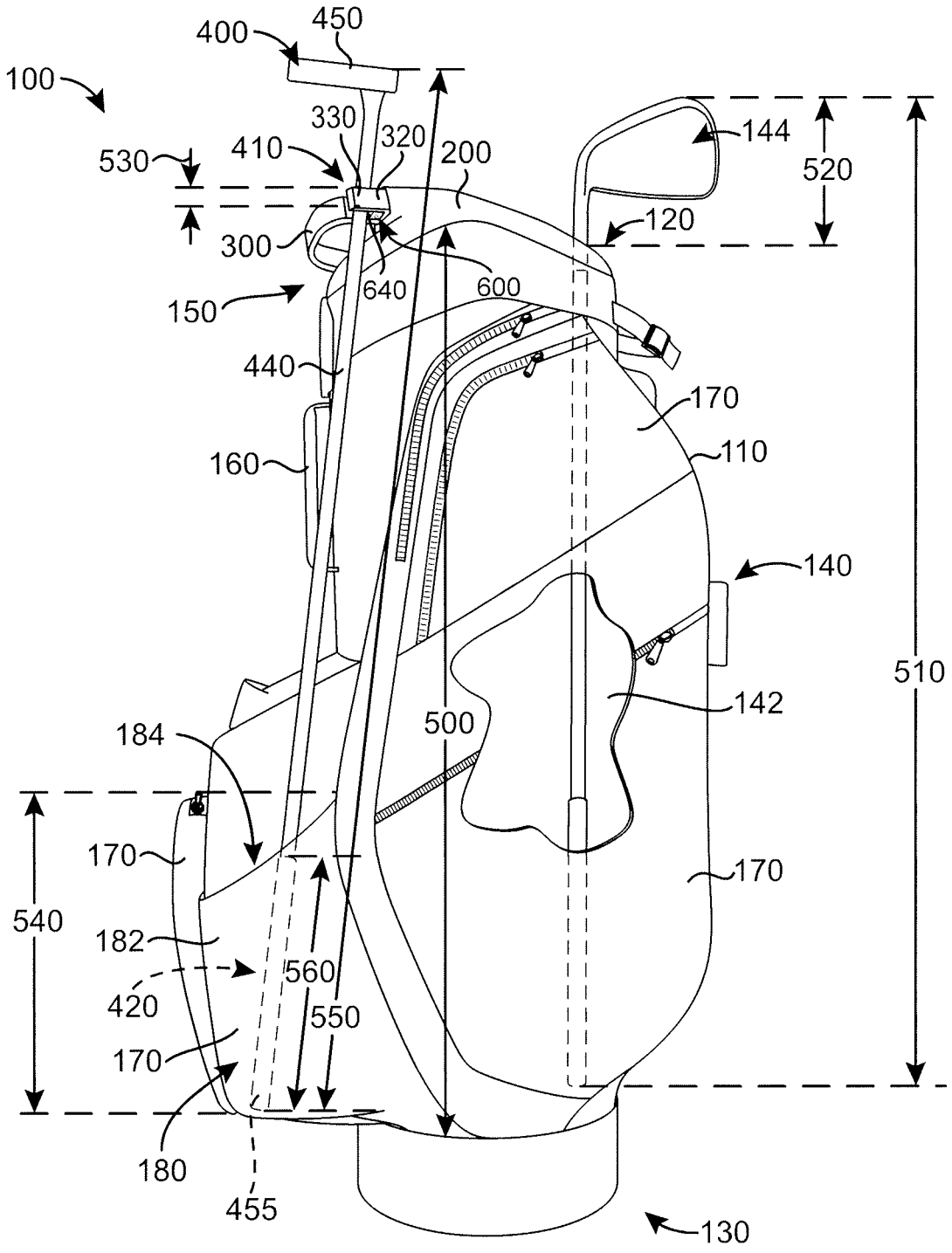
FIG. 14 depicts a side view of a golf bag with the golf bag top of FIG. 12 and the magnet cover of FIG. 10 installed thereon.

In FIGS. 12-14, and with continued reference to the magnet cover portion 600 of FIGS. 10 and 11, an alternative example of the club divider portion 200 is shown. Except for the features described below, the club divider portion 200 may be similar to that shown in FIGS. 1-9. In the illustrated example, the club fastener portion 320 of the handle portion 300 may include one or more locating features to aid installation and alignment of the magnet cover portion 600. Examples of locating features may include, but are not limited to, bosses, shims, pockets, depressions, locating pins, and threaded holes. The club fastener portion 320 may include a depression 700 on the underside 321 of the club fastener portion 320 and at least partially surrounding the cavity 350 opening. The depression 700 may be configured to fit the magnet cover portion 600 such that the body portion 610 of the magnet cover portion 600 sits flush with the underside 321 of the club fastener portion 320. The depression 700 may include a first locating hole 710 positionally aligned with the first boss 660 of the magnet cover portion 600 and configured to receive the first boss 660 therein. The depression 700 may include a second locating hole 715 positionally aligned with the second boss 665 of the magnet cover portion 600 and configured to receive the second boss 465 therein. The depression 700 may include a threaded hole 720 positionally aligned with the through-hole 690 of the magnet cover portion 600 and configured to receive a threaded fastener 691 inserted through the through-hole 690 to secure the magnet cover portion 600 to the club fastener portion 320, as shown in FIG. 13. The apparatus, methods, and articles of manufacture described herein are not limited in this regard.

As illustrated in the example depicted in FIGS. 10-14, the magnet cover portion 600 may be placed inside the depression 700 such that the first and second bosses 660 and 665 are received inside the corresponding first and second locating holes 710 and 715 and the shim portion 680 is received inside the cavity 350 on the underside 321 of the club fastener portion 320. A threaded fastener 691 may be inserted through the through-hole 690 and coupled to the threaded hole 720 to secure the magnet cover portion 600 to the club fastener portion 320, as shown in FIG. 13. In another example, the magnet cover portion 600 may be glued in place using an adhesive in lieu of a fastener. In another example, the shim portion 680 may be made from a metal material and the magnet cover portion 600 may be secured in place via a magnetic attraction between the shim portion 680 and the magnetic portion 340 housed inside the cavity 350 on the underside 321 of the club fastener portion 320. Securing the magnet cover portion 600 to the club fastener portion 320 may result in the outer portion 360 of the magnetic portion 340 being entirely or partially covered by the flap portion 640 of the magnet cover portion 600. Accordingly, the first boss 660, the second boss 665, and the shim portion 680 may collectively function to align the flap portion 640 with the outer portion 360 of the magnetic portion 340. In another example, the shim portion 680 may be omitted if the cavity 350 is entirely occupied by the magnetic portion 340. In another example, the magnet cover portion 600 may include only the flap portion 640 (i.e., without any other parts) and may be attached to the magnetic portion 340 with an adhesive or a bonding agent. In operation, the flap portion 640 may serve as a physical barrier. The flap portion 640 may physically separate and prevent direct contact between the magnetic portion 340 and the first shaft portion 410 engaged to the club fastener portion 320 without prohibiting magnetic attraction therebetween, as shown in FIG. 14. By constructing the flap portion 640 from a softer material than the ferromagnetic material of the magnetic portion 340, the flap portion 640 may be less abrasive than the magnetic portion 340, and as a result, when the shaft 440 is engaged by the club fastener portion 320 and contacts the flap portion 640, the shaft is less likely to be marred during transport than if it was otherwise directly contacting the magnetic portion 340. The apparatus, methods, and articles of manufacture described herein are not limited in this regard.

Figure 15:
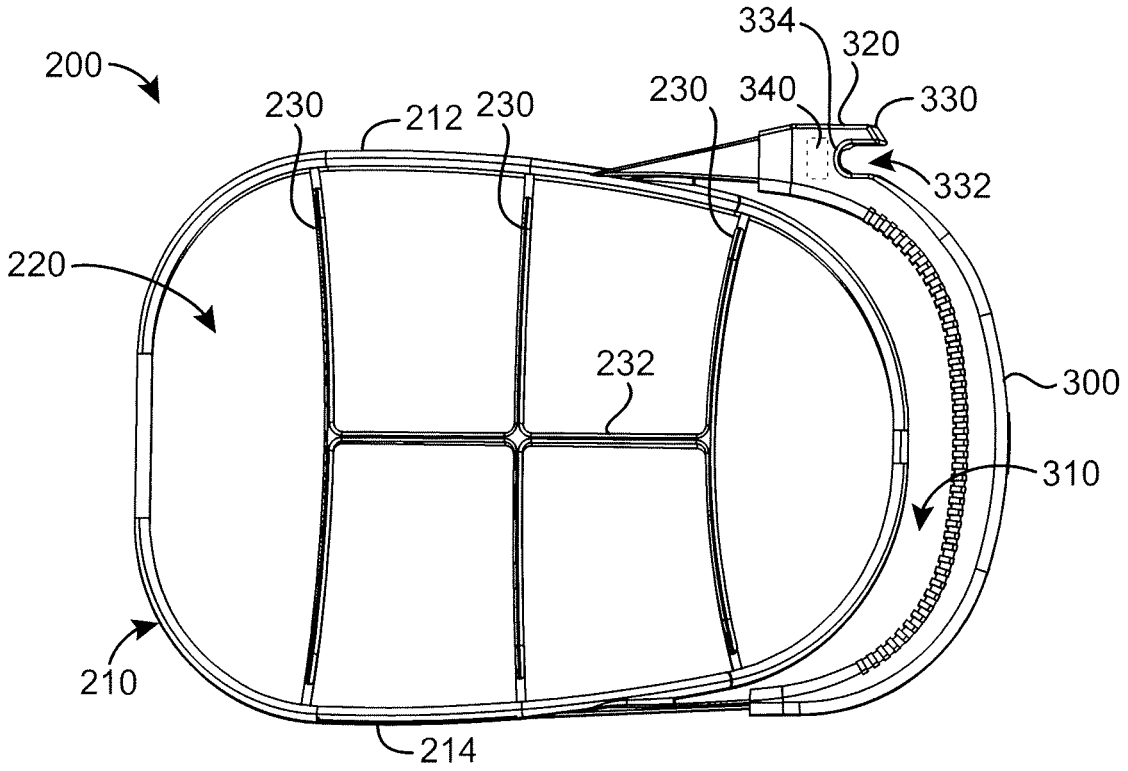
FIG. 15 depicts a top view of a golf bag top according to an exemplary embodiment of the apparatus, methods, and articles of manufacture described herein.
Figure 16:
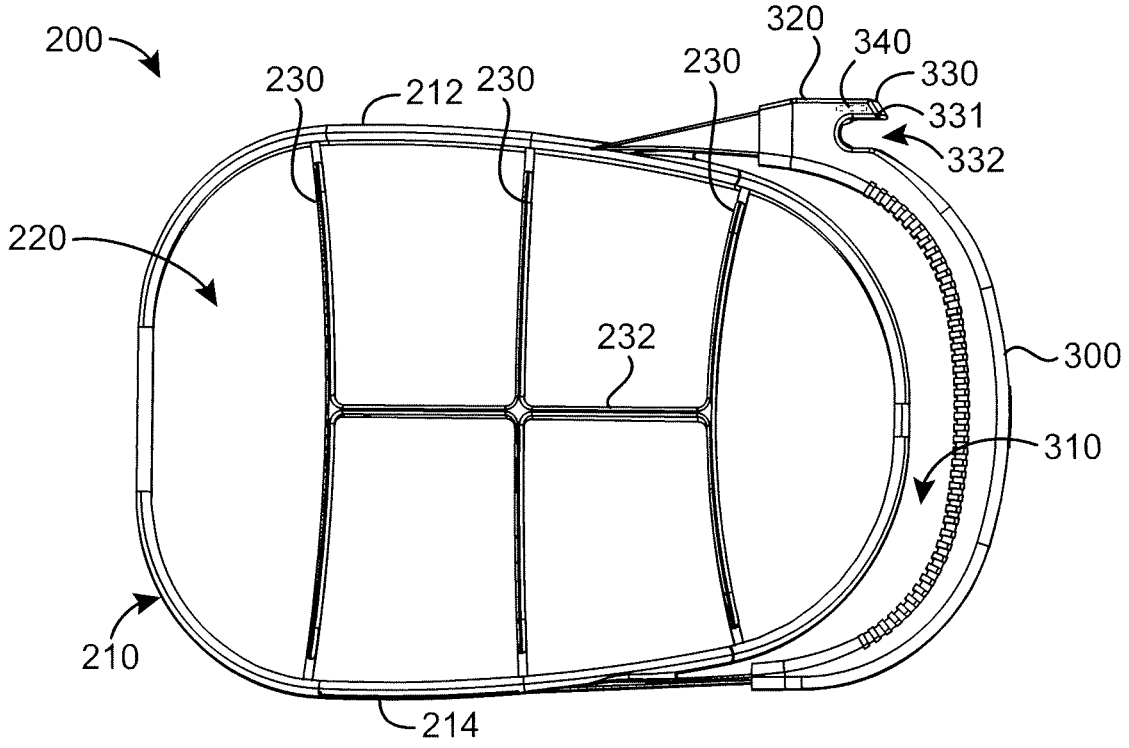
FIG. 16 depicts a top view of a golf bag top according to an exemplary embodiment of the apparatus, methods, and articles of manufacture described herein.
Figure 17:
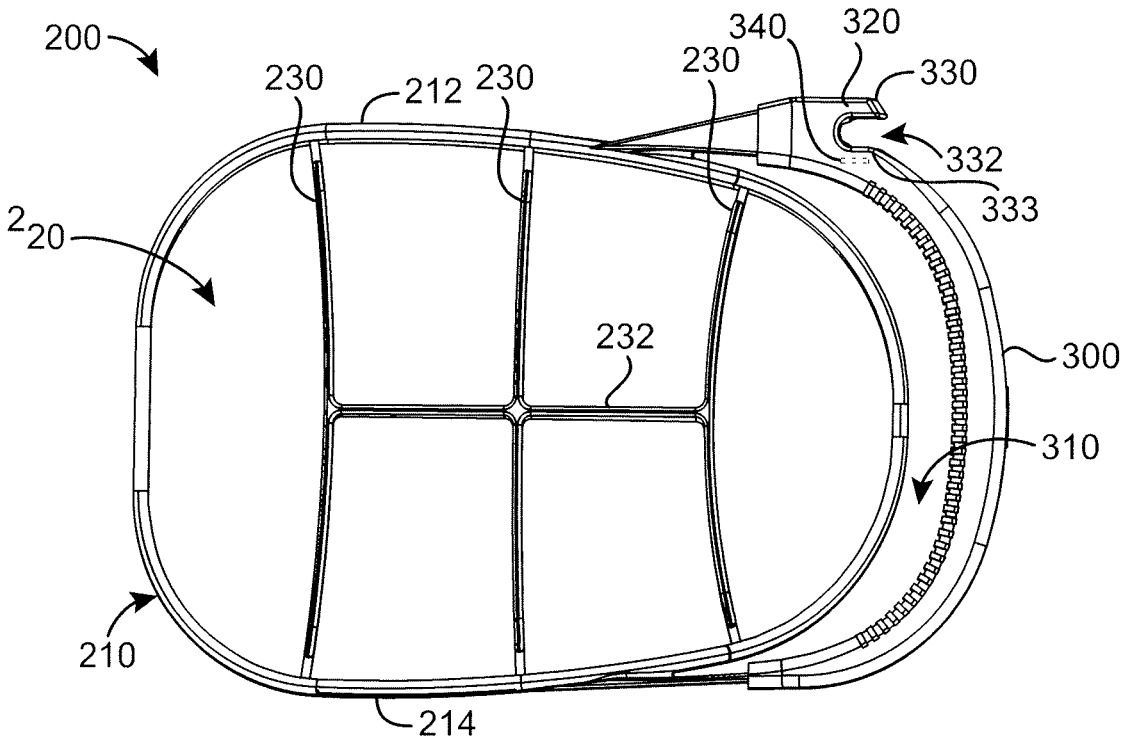
FIG. 17 depicts a top view of a golf bag top according to an exemplary embodiment of the apparatus, methods, and articles of manufacture described herein.

In the example shown in FIG. 4, the magnetic portion 340 may be visible after it is installed in the cavity of the club fastener portion 320. Installation of the magnet cover portion 600 may prevent direct contact between the shaft 440 of the golf club 400 and the magnetic portion 340 and thereby protect the shaft from abrasion. In other examples, the magnetic portion 340 may be located within the club fastener portion 320 and be separated from the shaft 440 by a portion of the club fastener portion 320, thereby preventing direct contact between the shaft 440 and magnetic portion 340 and protecting the shaft. For example, as shown in FIG. 15, the magnetic portion 340 may be located at or proximate to the arcuate portion 334 of the U-shaped portion. In another example, as shown in FIG. 16, the magnetic portion 340 may be located at or proximate to the first arm portion 331 of the U-shaped portion 330. In another example, as shown in FIG. 17, the magnetic portion 340 may be located at or proximate to the second arm portion 333 of the U-shaped portion 330. Except for the location of the magnetic portion 340, the alternative examples of the club divider portion shown in FIGS. 15-17 may be similar to the club divider portion 200 shown in FIGS. 1-9. The apparatus, methods, and articles of manufacture described herein are not limited in this regard.

Although club fastener portions 320 with magnetic portions 340 are shown and described in FIGS. 1-14, the club fastener portion 320 may include any suitable type of club fastening means, with or without a magnetic portion, configured to hold a shaft 440 of the golf club 400 (e.g., via the first shaft portion 410). The club fastening means may be configured to retain a shaft 440 of the golf club 400 at a fastening location outside of the first housing portion 140 and proximate to the top portion 120 of the golf bag 100. In some examples, the club fastening means may include a magnetic portion, a clamp, a spring-loaded claw, a detent, a latch, a flap, a plurality of bristles, or a combination thereof. It should be understood that any suitable type of club fastening means may be utilized. The club fastening means may be configured to receive the shaft 440 from a substantially horizontal direction of insertion, rather than a vertical direction of insertion, to permit use in confined spaces, such as when the golf bag 100 is positioned in a golf cart with a roof. The apparatus, methods, and articles of manufacture described herein are not limited in this regard.

Figure 18:
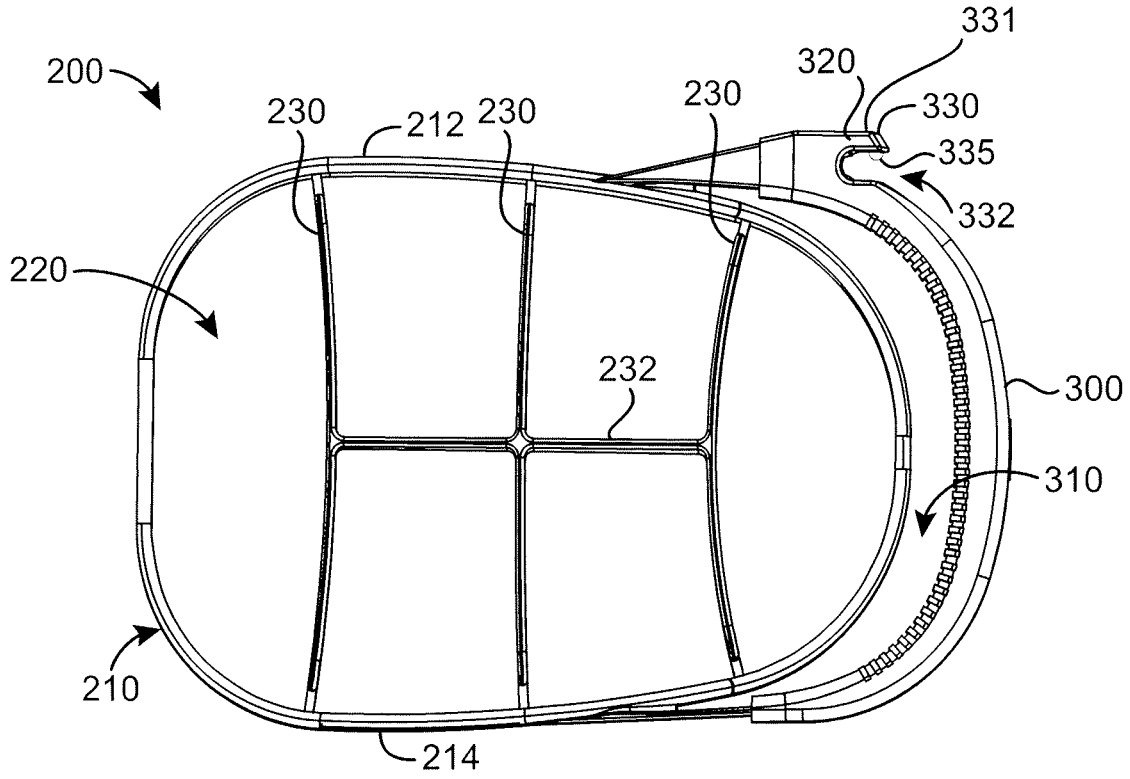
FIG. 18 depicts a top view of a golf bag top according to an exemplary embodiment of the apparatus, methods, and articles of manufacture described herein.

As illustrated in the example of FIG. 18, the fastener portion 320 of the club divider portion 200 may include a detent 335. The detent 335 may be located on a surface of the U-shaped portion 330. In one example, the detent 335 may be made of a relatively soft material (e.g., thermoplastic elastomer) that compresses while the shaft 440 is being forced past the detent into the space 332 and then resumes its original shape after the shaft has passed, thereby serving to retain the shaft within the space 332. In another example, the detent 335 may be a spring-loaded detent that retracts into the arm portion while the shaft 440 is being forced past the detent into the space 332 and then resumes its original position after the shaft has passed, thereby serving to retain the shaft within the space 332. The detent may be located at any location on the U-shaped portion 330. In one example, the detent 335 may be located on the first arm portion 331, as shown in FIG. 18. In another example, the detent may be located on the second arm portion 333. The apparatus, methods, and articles of manufacture described herein are not limited in this regard.

Figure 19:
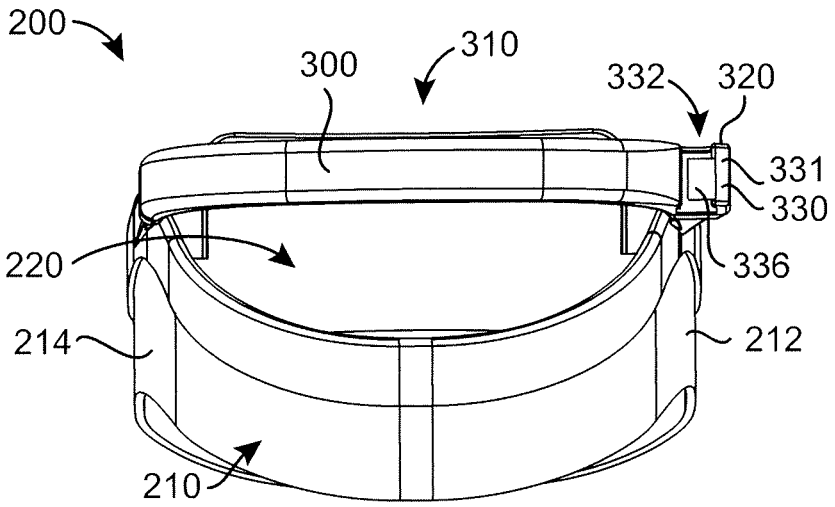
FIG. 19 depicts a front view of a golf bag top according to an exemplary embodiment of the apparatus, methods, and articles of manufacture described herein.
Figure 20:
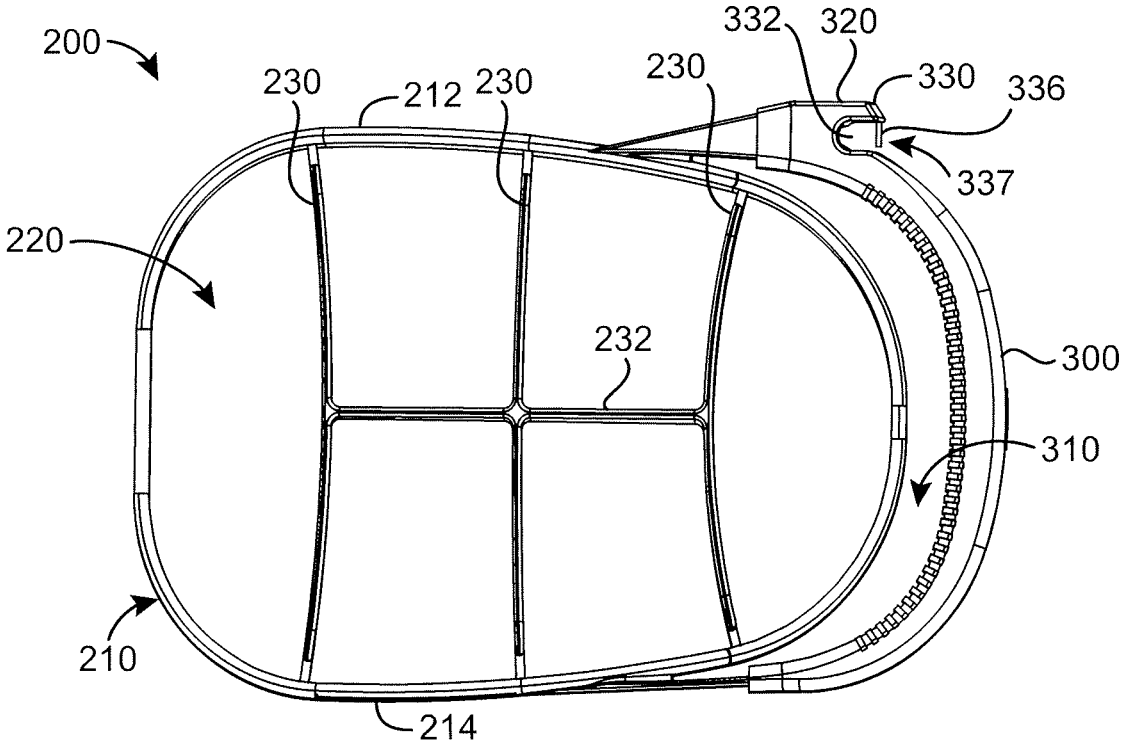
FIG. 20 depicts a top view of the golf bag top of FIG. 19.

As illustrated in the example of FIGS. 19 and 20, the fastener portion 320 of the club divider portion 200 may include a flap 336. The flap 336 may be located at or proximate to the mouth portion 337 of the U-shaped portion 330. The flap 336 may have a first end that is attached to the U-shaped portion 330 and a second end that is free. The flap 336 may be hinged or pivotally attached at the first end to the U-shaped portion 330 with one or more resistance devices such as a torsional spring or an elastomer that may provide resistance when the flap 336 is pivoted. Alternatively, the flap 336 may be fixedly attached at the first end and constructed from a flexible material that provides pending resistance. Accordingly, the flap 336 may resist any pivoting or bending. In one example, as shown in FIGS. 19 and 20, the flap 336 may be attached to the first arm portion 331. In another example, the flap 336 may be attached to the second arm portion 333. The flap 336 may be configured to swing or bend inward when the shaft 440 is being forced into the space 332 of the U-shaped portion 330 and then close when the shaft has passed the flap, thereby retaining the shaft within the space 332 due to the pivoting or bending resistance provided by the flap 336 as described herein. The flap 336 may be configured to swing or bend outward when the shaft 440 is being removed from the club fastener portion. The apparatus, methods, and articles of manufacture described herein are not limited in this regard.

Figure 21:
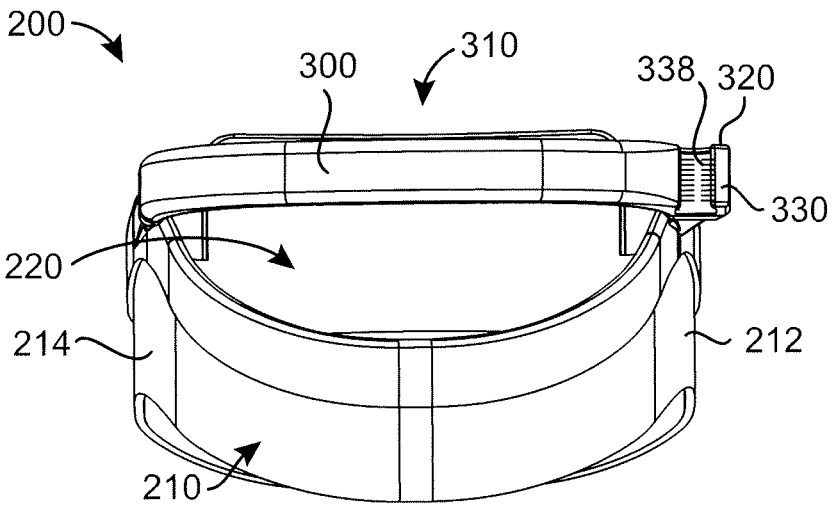
FIG. 21 depicts a front view of a golf bag top according to an exemplary embodiment of the apparatus, methods, and articles of manufacture described herein.
Figure 22:
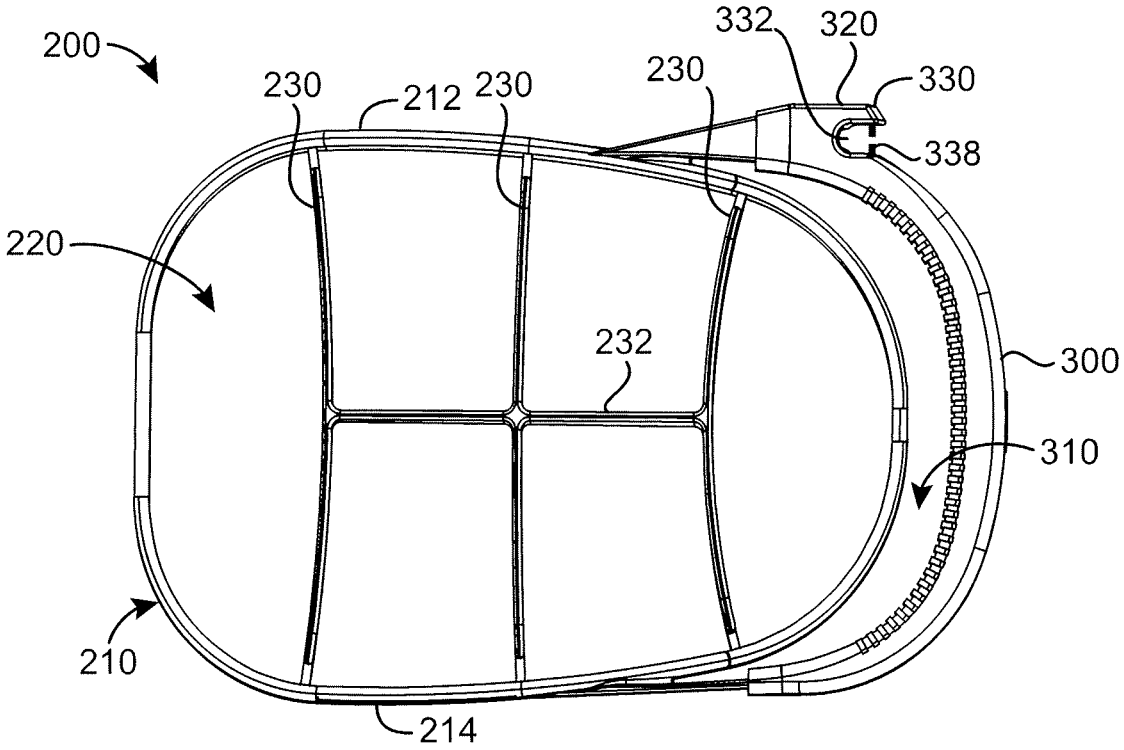
FIG. 22 depicts a top view of the golf bag top of FIG. 21.

As illustrated in the example of FIGS. 21 and 22, the fastener portion 320 of the club divider portion 200 may include a plurality of bristles 338. The plurality of bristles 338 may be located at or proximate to the mouth portion 337 of the U-shaped portion. The plurality of bristles 338 may be configured to deflect when the shaft 440 is being forced into the space 332 of the U-shaped portion 330 and then return to their original positions after the shaft has passed. The bristles 338 may be elastic and yet have sufficient rigidity to maintain the shaft within the space 332. In one example, the plurality of bristles may extend from the first arm portion 331. In another example, the plurality of bristles may extend from the second arm portion 333. In yet another example, as shown in FIGS. 21 and 22, the plurality of bristles 338 may include a first plurality of bristles extending from the first arm portion 331 and a second plurality of bristles extending from the second arm portion 333. The apparatus, methods, and articles of manufacture described herein are not limited in this regard.

Although a particular order of actions may be described herein with respect to one or more processes, these actions may be performed in other temporal sequences. Further, two or more actions in any of the processes described herein may be performed sequentially, concurrently, or simultaneously.

A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "and" and "or" may have both conjunctive and disjunctive meanings. The terms "a" and "an" are defined as one or more unless this disclosure indicates otherwise. The term "coupled", and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf bag top comprising:
- a club divider portion having a perimeter portion and one or more rib portions extending from a first inner wall of the perimeter portion to a second inner wall of the perimeter portion to define a plurality of openings;
- a handle portion extending from a first outer wall of the club divider portion to a second outer wall of the club divider portion, the handle portion extending beyond the perimeter portion of the club divider portion to define a handle opening between the handle portion and the club divider portion;
- a club fastener portion extending from the handle portion, the club fastener portion comprising:
  - a U-shaped portion defining a space configured to receive a shaft of a golf club;
  - a cavity in a bottom portion of the club fastener portion;
  - a magnetic portion within the cavity; and
  - a depression in the bottom portion of the club fastener portion; and
- a magnet cover portion comprising:
  - a body portion configured to fit the depression; and
  - a flap portion extending from the body portion and positioned between the magnetic portion and the space defined by the U-shaped portion,
- wherein the flap portion is configured to separate the magnetic portion and the shaft, and wherein the magnetic portion is configured to magnetically attract the shaft against the flap portion.

2. A golf bag top as defined in claim 1, wherein the depression comprises a locating hole, wherein the magnet cover portion comprises a boss extending from the body portion, and wherein the boss is received in the locating hole.

3. A golf bag top as defined in claim 1, wherein the depression comprises a first locating hole and a second locating hole, wherein the magnet cover portion comprises a first boss extending from the body portion and a second boss extending from the body portion, and wherein the first boss is received in the first locating hole and the second boss is received in the second locating hole.

4. A golf bag top as defined in claim 1, wherein the body portion includes a shim portion configured to fit in the cavity and a boss portion configured to fit in a locating hole in the depression, and wherein the shim portion and the boss portion collectively align the flap portion with the magnetic portion.

5. A golf bag top as defined in claim 1, wherein the club divider portion comprises a spine portion that interconnects the one or more rib portions to define the plurality of openings.

6. A golf bag top as defined in claim 1 further comprising a through-hole in the body portion of the magnet cover portion, a threaded hole in the depression, and a threaded fastener inserted through the through-hole and threaded into the threaded hole to fasten the magnet cover portion to the club fastener portion.

7. A golf bag top as defined in claim 1, wherein the U-shaped portion is spaced apart from the club divider portion by at least one shaft diameter.

8. A golf bag top comprising:
- a club divider portion having a perimeter portion;

a handle portion attached to the club divider portion and extending beyond the perimeter portion; and a club fastener portion coupled to the handle portion, the club fastener portion configured to hold a shaft of a golf club, the club fastener portion comprising:

a cavity in a bottom portion of the club fastener portion; and a magnetic portion within the cavity; and a magnet cover portion coupled to the club fastener portion and including a flap portion partially or entirely covering a portion of the magnetic portion, wherein the flap portion is between the magnetic portion and the shaft, and wherein the magnetic portion is configured to magnetically attract the shaft.

9. A golf bag top as defined in claim 8, wherein the club fastener portion comprises a U-shaped portion having a first arm portion, a second arm portion, and an arcuate portion connecting the first arm portion to the second arm portion, wherein the cavity is located in the U-shaped portion.

10. A golf bag top as defined in claim 8, wherein the magnet cover portion comprises a shim portion made of a metal material configured to fit within the cavity and be magnetically attracted to the magnetic portion to couple the magnet cover portion to the club fastener portion.

11. A golf bag top as defined in claim 8, wherein the club fastener portion comprises a U-shaped portion defining a space having a width that is greater than or equal to a maximum outer diameter of the shaft.

12. A golf bag top as defined in claim 8, wherein the magnet cover portion comprises a body portion comprising a first material, and the flap portion comprises a second material that is softer than the first material and softer than a ferromagnetic material of the magnetic portion.

13. A golf bag top as defined in claim 8, wherein the flap portion is a tongue-shaped flap portion.

14. A golf bag top comprising:

a club divider portion having a plurality of openings configured to receive one or more golf club shafts;

a handle portion for carrying a golf bag, the handle portion being attached to the club divider portion;

a club fastener portion integrated into the handle portion, the club fastener portion configured to receive a shaft of a golf club, the club fastener portion comprising a magnetic portion configured to magnetically attract the shaft; and a magnet cover portion coupled to the club fastener portion, the magnet cover portion comprising a body portion and a flap portion extending from the body portion, the flap portion covering at least a portion of the magnetic portion, wherein the flap portion is located between the magnetic portion and the shaft, and wherein the flap portion physically separates the magnetic portion and the shaft without prohibiting magnetic attraction between the magnetic portion and the shaft.

15. A golf bag top as defined in claim 14 further comprising one or more locating features on the magnet cover portion to aid installation onto the club fastener portion.

16. A golf bag top as defined in claim 14 further comprising a first locating feature in a bottom side of the club fastener portion and a second locating feature extending from the body portion, wherein the first locating feature receives the second locating feature.

17. A golf bag top as defined in claim 14 further comprising a cavity in the club fastener portion, the magnetic portion located in the cavity.

18. A golf bag top as defined in claim 14, wherein the handle portion has a first color, and the magnet cover portion has a second color that is different from the first color.

19. A golf bag top as defined in claim 14, wherein the club fastener portion comprises a depression, and wherein the body portion of the magnet cover portion fits in the depression and is flush with an exterior surface of the club fastener portion.

20. A golf bag top as defined in claim 14 further comprising:

a cavity in the club fastener portion, the magnetic portion located in the cavity; and a shim portion extending from a top portion of the body portion, the shim portion configured to extend into the cavity and abut the magnetic portion.

* * * * *